US008567020B1

(12) United States Patent
McGarity et al.

(10) Patent No.: US 8,567,020 B1
(45) Date of Patent: Oct. 29, 2013

(54) CLIP WITH RETRACTABLE LEVERS

(75) Inventors: Ronald M. McGarity, Savannah, GA (US); Mark McGarity, Savannah, GA (US)

(73) Assignee: Geraghty, LLC, Savannah, GA (US)

( * ) Notice: Subject to any disclaimer, the term of this patent is extended or adjusted under 35 U.S.C. 154(b) by 0 days.

(21) Appl. No.: 12/931,977

(22) Filed: Feb. 14, 2011

Related U.S. Application Data

(60) Provisional application No. 61/337,958, filed on Feb. 12, 2010.

(51) Int. Cl.
*B42F 1/00* (2006.01)

(52) U.S. Cl.
USPC ..... 24/511; 24/67.3; 24/67.5; 24/508; 24/557; 24/558; 24/565

(58) Field of Classification Search
USPC ..... 24/67.5, 499, 513, 500, 501, 511, 508, 24/557, 565, 558, 67.3; 223/96, 93, 90
See application file for complete search history.

(56) References Cited

U.S. PATENT DOCUMENTS

| | | | | | |
|---|---|---|---|---|---|
| 3,137,027 | A | * | 6/1964 | Birkle | 16/87.2 |
| 3,928,894 | A | * | 12/1975 | Bury et al. | 248/467 |
| 5,573,151 | A | * | 11/1996 | Fildan | 223/96 |
| 5,946,778 | A | * | 9/1999 | McGarity | 24/536 |
| 6,988,296 | B1 | * | 1/2006 | McGarity et al. | 24/67.3 |
| D552,008 | S | * | 10/2007 | McGarity | D11/78.1 |
| D592,987 | S | * | 5/2009 | McGarity et al. | D11/78.1 |
| 2006/0076094 | A1 | * | 4/2006 | Kaminski | 150/147 |

* cited by examiner

*Primary Examiner* — Robert J Sandy
*Assistant Examiner* — David Upchurch
(74) *Attorney, Agent, or Firm* — Rodgers & Rodgers

(57) ABSTRACT

A clip having a pair of operating levers slidably interconnected respectively to a pair of jaws joined together by a curved throat, an elongated slot formed on the inner side of each operating lever, a spring pocket formed in the outer surface of each jaw, a spring tab disposed in each pocket with an upstanding resilient stop tab joined to the spring tab and being disposed in the slot.

6 Claims, 2 Drawing Sheets

CLIP WITH RETRACTABLE LEVERS

The benefits under 35 U.S.C. 119 are claimed of provisional patent application 61/337,958 filed Feb. 12, 2010.

BACKGROUND OF THE INVENTION

This invention relates to clips in general and specifically to money clips with retractable levers as shown in U.S. Pat. Nos. 5,946,778, 6,988,296, D552,008 and D592,987. Money clips as disclosed and claimed in these patents have been well received by the public but have certain drawbacks related to them being constructed of multiple parts which require precise machining detailed assembly or other appropriate manufacturing processes.

BRIEF SUMMARY OF THE INVENTION

A clip, and especially a money clip, includes operating levers which extend outwardly for the purpose of opening the clip and which retract inwardly in a compact fashion. The clip includes a spring comprising a pair of jaws biased inwardly with a pair of slots formed on the outer surface of each jaw for the purpose of receiving the operating levers. A spring pocket is formed on the outer surface of each jaw to receive a spring tab. The spring tab comprises a base with an upwardly extending stop tab disposed in an elongated slot formed on the inside surface of the respective lever for the purpose of preventing withdrawal of the operating levers from the clip.

BRIEF DESCRIPTION OF THE SEVERAL VIEWS OF THE INVENTION

DETAILED DESCRIPTION OF THE INVENTION

Figure 1:
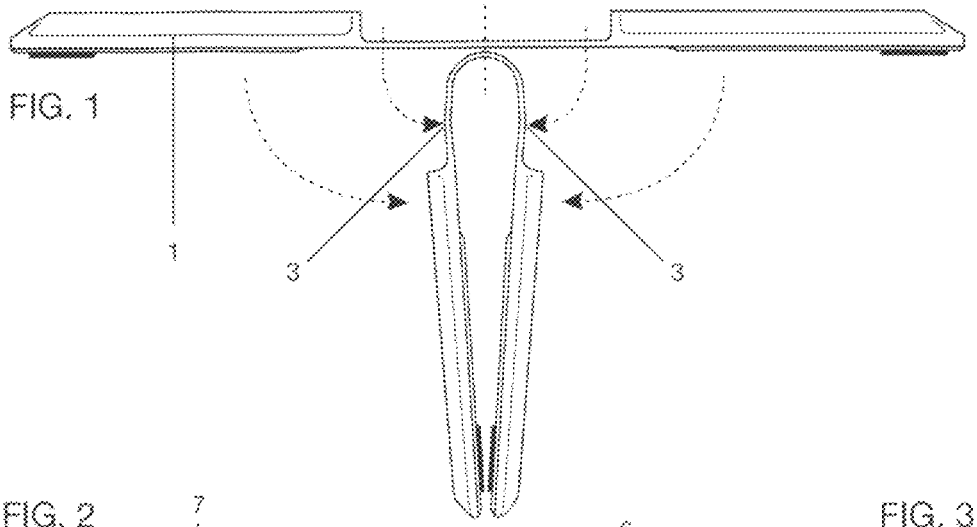
FIG. 1 is a side elevational view depicting formation of the clip according to this invention.
Figure 2:
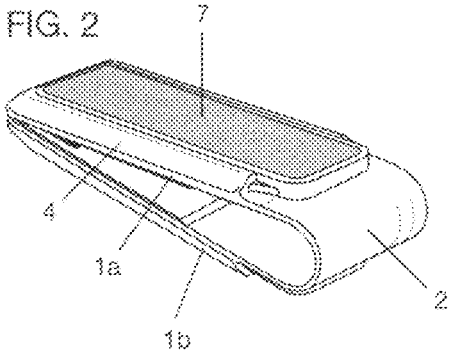
FIG. 2 is a perspective view of the clip including the operating levers.
Figure 3:
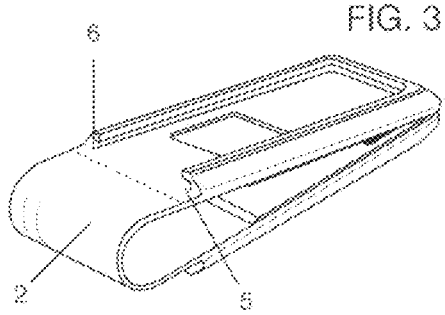
FIG. 3 is a perspective view of the clip without the operating levers.
Figure 4:
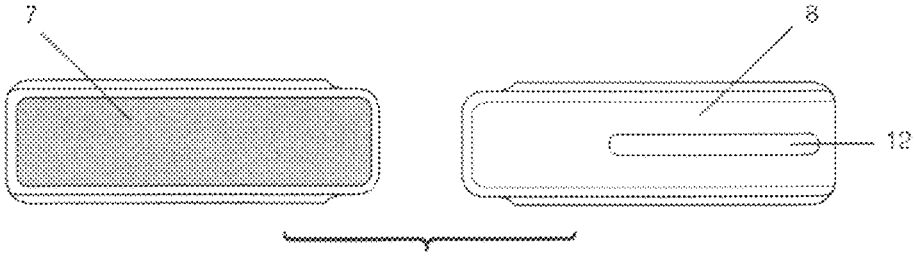
FIG. 4 is a plan view showing the upper and lower surfaces of the operating lever.
Figure 5:
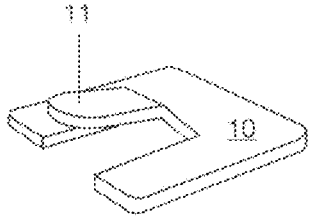
FIG. 5 is a perspective view of the spring clip.
Figure 6:
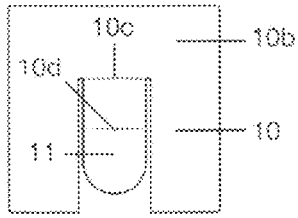
FIG. 6 is a plan view of the spring clip.
Figure 7:
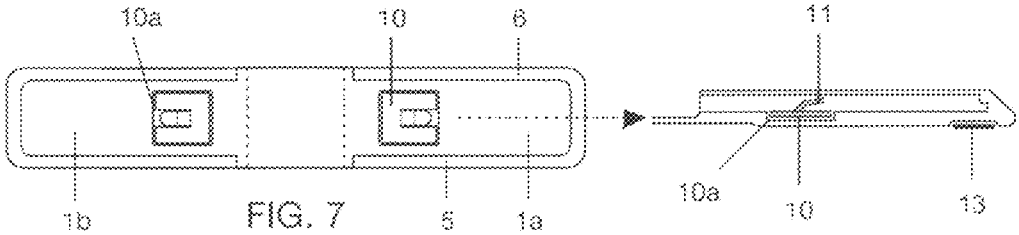
FIG. 7 is a plan view of the spring in an unfolded condition.
Figure 8:
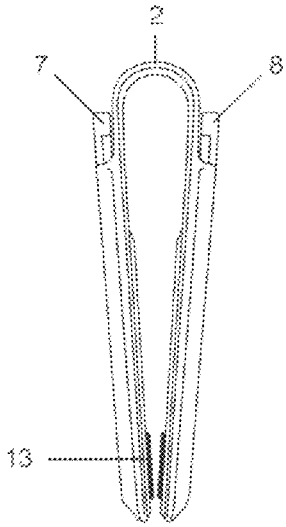
FIG. 8 is an elevational view of the completed clip.
Figure 9:
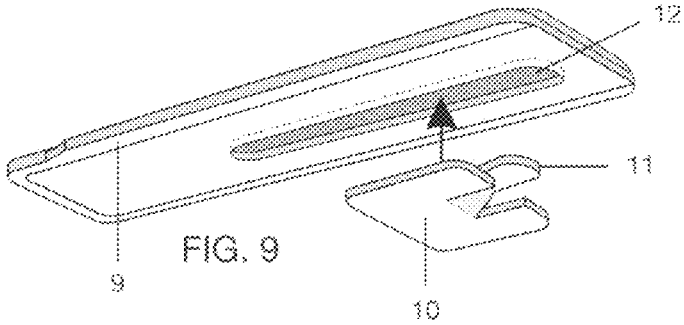
FIG. 9 is a partially exploded view of the underside of the operating lever and associated spring tab.

The clip, according to this invention, is constructed of a single piece of material that initially is flat and is then shaped by various methods of production to include top, front and side edges that are made as integral elements of the spring itself. Spring 1 is produced from any material that can be shaped and formed as needed such as heat treated metal, plastic, carbon composites, etc. The clip is shaped, sized, configured and designed to accommodate the desired effect for the particular function and design for which it is intended, i.e., money clips, paper clamps, bag clips, etc. Spring 1 includes jaws 1*a* and 1*b* extending from curved throat 2. Spring 1 may include one or more separate additional bends 3 to allow increased flex in the overall opening and closing action of the spring.

Bosses 4 are integrally formed on the outer surfaces of jaws 1*a* and 1*b* of spring 1. The inner edges of boss 4 are shaped to include spaced slots 5 and 6 in which separate and independent operating levers 7 and 8 are received which are designed and made to slide within slots 5 and 6 of bosses 4. The bosses act as receivers which allow operating levers 7 and 8 to move within slots 5 and 6.

Operating levers 7 and 8 are designed with runner edges that are inserted into slots 5 and on spring 1 to allow them to be guided back and forth into a closed or extended position. These runners on the side edge of each operating lever 7 and 8 are designed with edges which are offset from the main operating lever planar base element and which function as sliding points or rails 9 which are used to allow minimal contact with spring 1, ultimately resulting in minimal friction contact points and improved sliding action. Also, operation levers 7 and 8 are designed and made to allow the insertion or application of various materials to adorn the top, bottom or sides to produce a desirable cosmetic affect and appeal for the marketplace.

The clip includes at least one specially designed spring tab stop mechanism 10 on each side of the clip that is disposed under the operating levers 7 and 8. Spring tab 10 is mounted temporarily or permanently in spring pocket 10*a* formed in each of the outer surfaces of jaws 1*a* and 1*b*. The shape and size of spring tab 10 is designed to conform to the shape and size of spring pocket 10*a* which could be square, rectangular, triangular or any other suitable configuration. Spring tab 10 functions as a stop mechanism for operating levers 7 and 8 to prevent them from sliding out of spring 1 and to limit the extension of each lever to its desired maximum.

Resilient stop tab 11 of spring tab 10 applies tension to operating levers 7 and 8 to create the proper sliding action and feel required for the clip as a result of pressing upward into elongated slot 12 formed in the underside of each operating lever 7 and 8. Specifically, upstanding stop tab 11 is joined to base 10*b* of spring tab 10 along bend line 10*c* with bend line 10*d* formed generally midway of tab 11.

In operation, as operating levers 7 and 8 are withdrawn outwardly of the clip, stop tabs 11 are caused to slide in slots 12 until such time that the outer rounded tips of stop tabs 11 engage the respective ends of slots 12 thereby preventing any further withdrawal of operating levers 7 and 8.

The underside of spring 1 includes one or more added grip pads 13. Additionally, particular markings, etchings or grip marks may also be formed on the underside of each side of spring 1 to separate the grip pads.

The invention claimed is:

1. A clip comprising a pair of jaws, a throat interconnecting said jaws to urge said jaws toward each other, said jaws comprising inner and outer surfaces, a pair of bosses formed respectively on the outer surfaces of said jaws, a pair of operating levers slidably mounted respectively in said bosses, said operating levers being extendable and retractable, each of said operating levers having an underside, a pair of elongated slots formed respectively in the undersides of said operating levers, said operating levers comprising spaced side edges, said elongated slots disposed substantially midway between said side edges, said elongated slots in a facing relation when said operating levers are fully retracted, a pair of spring pockets formed respectively in the outer surfaces of said jaws and disposed adjacent said elongated slots, said spring pockets being quadrilateral in shape, a pair of resilient spring tabs disposed respectively in said spring pockets, said spring tabs comprising a planar base, said planar base conforming to the shape and size of said spring pocket, a planar stop tab integrally joined to said planar base along a bend line, said stop tabs angularly disposed with respect to said planar base and partially disposed respectively within said elongated slots, said slots having spaced ends, said stop tabs having ends remote from said bend line, and said ends of said stop tabs being in abutting engagement respectively with the adjacent one of said spaced ends when said operating levers are fully extended.

2. A clip according to claim 1 wherein a second bend line is disposed generally midway in said stop tab.

3. A clip according to claim 1 wherein a pair of spaced slots are formed in each of said bosses.

4. A clip according to claim 1 wherein a second bend line is formed in each of said stop tabs.

5. A clip according to claim 1 wherein the distal ends of said stop tabs are rounded.

6. A clip according to claim 3 wherein each of said operating levers comprises side edges and said side edges comprise offset rails disposed respectively in said spaced slots.

* * * * *